US006346053B1

(12) United States Patent
Inoue et al.

(10) Patent No.: US 6,346,053 B1
(45) **Date of Patent: *Feb. 12, 2002**

(54) GOLF BALL

(75) Inventors: Michio Inoue; Keisuke Ihara, both of Chichibu (JP)

(73) Assignee: Bridgestone Sports Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/154,175

(22) Filed: Sep. 16, 1998

(30) Foreign Application Priority Data

Sep. 16, 1997 (JP) ..... 9-269288

(51) Int. Cl.[7] ..... A63B 37/14
(52) U.S. Cl. ..... 473/378; 473/383; 473/384
(58) Field of Search ..... 473/378–385

(56) References Cited

U.S. PATENT DOCUMENTS 4,142,727 A * 3/1979 Shaw et al.
4,880,241 A * 11/1989 Melvin ..... 473/384
5,024,444 A * 6/1991 Yamahishi et al.
5,072,945 A * 12/1991 Oka et al.
5,332,226 A * 7/1994 Kim
5,820,492 A * 10/1998 Yamagishi et al. ..... 473/384 X
5,823,888 A * 10/1998 Maruko ..... 473/384
5,863,264 A * 1/1999 Yamagishi et al. ..... 473/384 X

* cited by examiner

*Primary Examiner*—Stephen L. Blau
(74) *Attorney, Agent, or Firm*—Sughrue, Mion, Zinn, Macpeak & Seas, PLLC

(57) ABSTRACT

In a golf ball having on its surface a multiplicity of dimples, the dimples include a majority of large dimples with a diameter of 3.0 to 4.2 mm and account for at least 65% of the entire ball surface area. The large dimples have a depth of 0.1–0.35 mm, an edge angle of up to 30°, and a radius of curvature at the edge of 1–50 mm. Not only excellent flight performance is achieved, but the ball can be smoothly released from a mold at the end of molding.

6 Claims, 2 Drawing Sheets

GOLF BALL

This invention relates to a golf ball which can be readily released from a mold at the end of molding and which exhibits excellent flight performance.

BACKGROUND OF THE INVENTION

In general, golf balls are provided with a multiplicity of dimples of circular plane shape on their surface for the purpose of improving their aerodynamic properties. It is well known that the dimpled golf balls are far better in flight behavior than smooth golf balls free of dimples.

The flight distance of golf balls depends on the initial velocity, drag and lift acting on the ball during flight, spin rate, and other factors such as weather conditions. It is considered difficult to make a theoretical analysis on golf balls with the aim of increasing their flight distance.

For improving the flight performance of the ball except for the initial velocity which is largely governed by the material of the ball, a number of attempts of tailoring dimples relating to the geometrical factors of the ball have been made. Such attempts include, for example, increasing the diameter of dimples, increasing or decreasing the depth of dimples, changing the shape of dimples from circular one to polygonal and other shapes, and increasing or decreasing the number of dimples. For example, the number of dimples is increased as to maximize the proportion of the sum of dimple areas relative to the entire ball surface area (often referred to as "dimple surface coverage"), typically to achieve a dimple surface coverage of 65% or more. More or less fruitful results are obtained from these attempts.

Most often, golf balls are molded using a mold comprising a pair of removably mated mold sections. FIG. 4 shows one typical mold 20 including a pair of upper and lower mold sections 20*a* and 20*b* which are removably mated to define a spherical cavity 22. The cavity-defining surface of the mold has a negative dimple pattern, that is, is provided with a multiplicity of projections 21 for indenting dimples in the molding material. The mold sections 20*a* and 20*b* are divided along a parting line or plane P lying in register with the equator of the cavity 22. After a molding material is molded in the mold cavity to form a ball, the mold is opened and the ball is taken out from the lower mold section cavity.

In this regard, if dimples with a larger diameter and a greater depth are distributed so as to provide an increased dimple surface coverage, as mentioned above, for the purpose of improving the flight performance of the ball, the molding material is molded in such a mold with the dimple-forming projections being captured in dimples. Then, when the ball is taken out from the lower mold section cavity, some dimples are kept captured with dimple-forming projections disposed near the parting line, disturbing the ball removal from the mold. If the ball is forcibly taken out of the mold cavity, some dimples can be broken at their edge, detracting from the outer appearance and flight performance of the ball.

The golf ball mold mentioned just above is manufactured using a master model. The same problem arises when the mold is separated from the master model.

More particularly, current main techniques advantageously employed for manufacturing the mold are hobbing and precision casting techniques. These mold manufacturing techniques require a reversal step from the master model. When dents for forming the dimple-forming projections for molding large deep dimples are engraved in the master model, the reversal step becomes difficult, that is, the removal of the mold from the master model becomes difficult. If the mold is forcibly separated from the master model, the master model can be damaged.

The attempt to distribute large deep dimples on the ball surface at a high population for the purpose of improving the flight performance of the ball encounters a certain limit, failing to achieve fully satisfactory results.

SUMMARY OF THE INVENTION

An object of the present invention is to provide a golf ball having large deep dimples distributed on its surface at a high population, which when molded in a mold, is readily released from the mold and which exhibits excellent flight performance.

The present invention provides a golf ball having on its surface a multiplicity of dimples each delimited by an edge. The dimples include a majority of large dimples with a diameter of 3.0 to 4.2 mm and account for at least 65% of the entire surface area of the ball, the latter factor being referred to as "dimple surface coverage." The large dimples (that is, large diameter dimples) have a depth of 0.1 to 0.35 mm, an edge angle of up to 30°, and a radius of curvature at the edge of 1 to 50 mm.

In one preferred embodiment, the golf ball has a dimple volume occupation of 0.5 to 1.2%, provided that the dimple volume occupation is defined as the sum of volumes of dimple spaces each defined below a plane circumscribed by the dimple edge divided by the entire volume of an imaginary sphere given on the assumption that no dimples are on the golf ball surface.

Even though large deep dimples are distributed on the ball surface at a high population, the golf ball of the invention is readily released from a mold at the end of molding and exhibits excellent flight performance. More specifically, in a golf ball having on its surface a multiplicity of dimples including a majority of large dimples with a diameter of 3.0 to 4.2 mm and providing a percent dimple surface coverage of at least 65%, several advantages are obtained when the large dimples have a depth of 0.1 to 0.35 mm, an edge angle of up to 30°, and a radius of curvature at the edge of 1 to 50 mm, and preferably a percent dimple volume occupation of 0.5 to 1.2% is established. While large deep dimples are distributed on the ball surface to provide a high dimple surface coverage, the geometry of the dimple edge can be tailored optimum so as to cause no disturbance against removal from the mold. Even when many large deep dimples are distributed near the parting line of the mold, the ball is still improved in mold release, that is, the ball can be smoothly removed from the mold at the end of molding. Additionally, the large deep dimples distributed on the ball surface at a high population exert their aerodynamic effect to a full extent so that the ball exhibits excellent flight performance.

DETAILED DESCRIPTION OF THE INVENTION

Figure 1:
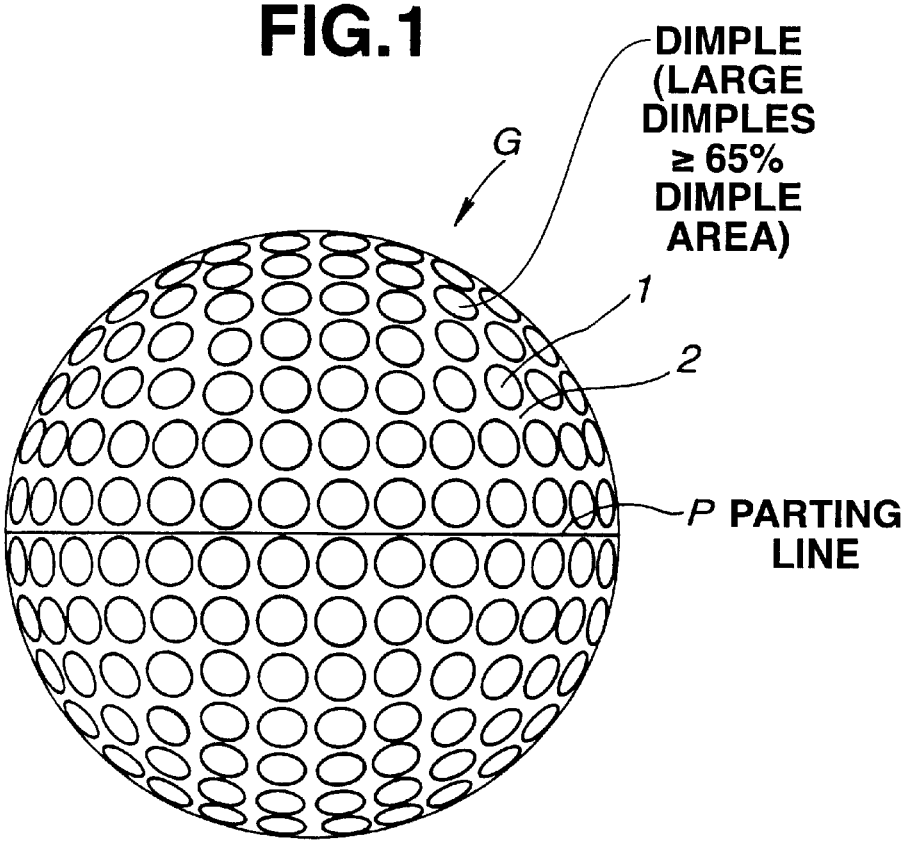
FIG. 1 illustrates a dimple arrangement pattern on a golf ball according to one embodiment of the invention.

As shown in FIG. 1, the golf ball of the invention, generally designated at G, has a multiplicity of dimples 1 of generally circular plane shape on its surface. The spherical surface of the golf ball G excluding the dimples is depicted as a land 2. The dimples are distributed at a high dimple surface coverage. The majority of dimples are relatively large deep dimples. In FIG. 1, P is a parting line corresponding to an equator of the ball.

In the present invention, the dimple diameter, dimple depth, edge angle and radius of curvature at the dimple edge are defined as follows.

Dimple Diameter

Figure 2:
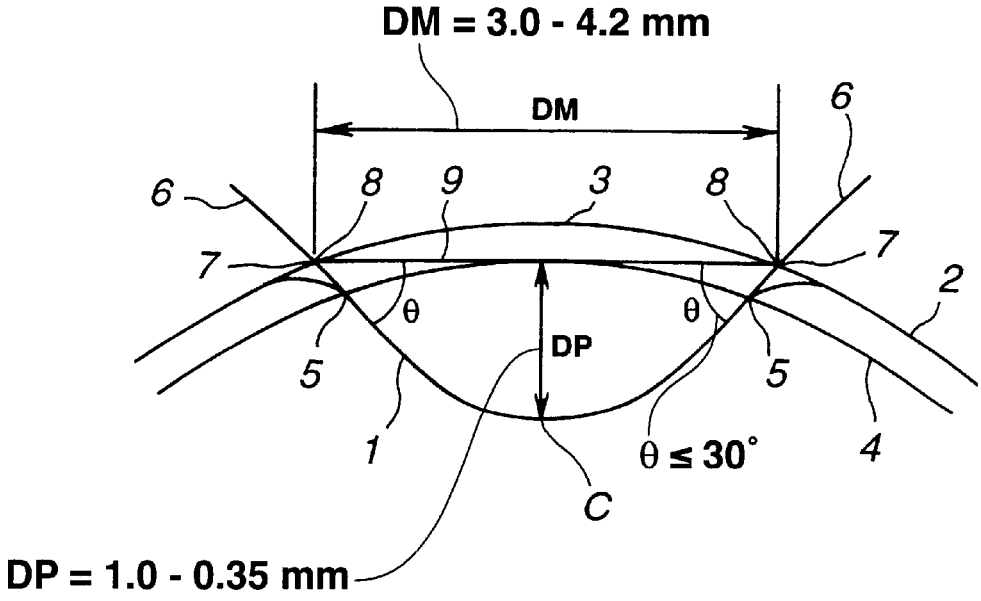
FIG. 2 is a schematic cross-sectional view of one dimple.

The cross-section of FIG. 2, viewed radially with respect to the ball center, passes the center C of a dimple 1. A land surface contour curve 3 consisting of the land 2 surface and an imaginary extension thereof (representing an imaginary spherical surface having the diameter of the ball) and an imaginary curve 4 spaced 0.04 mm inside from the contour curve 3 (or spherical surface having a radius 0.04 mm smaller than the ball radius) are drawn in conjunction with the dimple 1. The inside curve 4 intersects the dimple 1 at two points 5. The tangents 6 to the dimple 1 at these points 5, extended outward, intersect the contour curve 3 at reference points 7. The length DM of a straight line segment between reference points 7 and 7 is the diameter of the dimple.

Dimple Depth

In FIG. 2, a series of reference points 7 defines a circumference or dimple edge 8. The dimple edge 8 circumscribes a plane 9 which is a circle having the diameter DM. The length DP of a normal line segment extending from the plane 9 to the center C of the dimple is the depth of the dimple.

Edge angle

The edge angle is, as shown in FIG. 2, the angle θ between the tangent 6 at intersection 5 and the straight line segment between reference points 7 and 7 (or plane 9 circumscribed by dimple edge 8 ).

Radius of Curvature at the Dimple Edge

Figure 3:
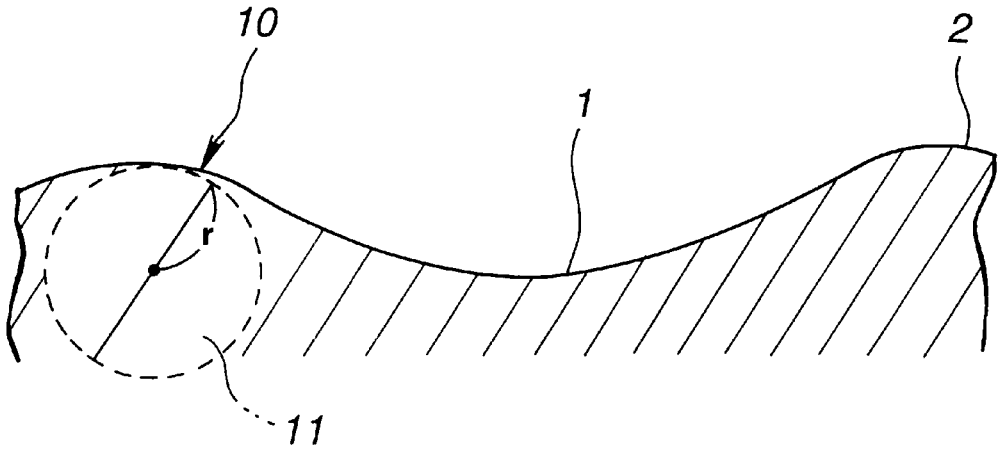
FIG. 3 is an enlarged view of one dimple illustrating the radius of curvature at a dimple edge.

Referring to FIG. 3, a dimple is shown in an enlarged view. An imaginary circle 11 is inscribed to the dimple edge 10 which is the boundary between the dimple 1 and the land 2. The radius r of this imaginary circle 11 is the radius of curvature at the dimple edge. The radius of curvature at the dimple edge represents the roundness of the dimple edge.

The diameter, depth and edge angle of a dimple are so defined for the reason that the exact position of the dimple edge cannot be otherwise determined because the actual edge of a dimple 1 is generally rounded.

In the golf ball of the invention, the dimples include a majority of large dimples with a diameter DM of 3.0 to 4.2 mm, preferably 3.3 to 4.0 mm. The term "majority" means that the large dimples account for 50 to 100% of the entire dimples. If the majority comprises dimples with a diameter of less than 3.0 mm, little dimple effect on flight performance is expectable. A dimple diameter in excess of 4.2 mm is too large, and it becomes difficult to distribute such large dimples at a high dimple surface coverage, failing to achieve the desired dimple effect.

The large dimples should have a depth DP of 0.1 to 0.35 mm, preferably 0.15 to 0.25 mm. With a dimple depth of less than 0.1 mm, the dimple effect is substantially lost. With a dimple depth of more than 0.35 mm, it becomes difficult to remove the ball from the mold. It is noted that the planar shape of dimples is preferably circular though not limited thereto.

In the golf ball of the invention, only the large circular dimples of the same type may be arranged. Dimples of plural types, usually at most 4 types, which are different in diameter and/or depth may be arranged insofar as large circular dimples are the majority.

The golf ball of the invention having dimples whose majority consists of the large dimples has a dimple area coverage of at least 65%, preferably 65 to 85%. The dimple area coverage is the sum of areas of dimples (plane or circle 9 in FIG. 2) divided by the entire surface area of an imaginary sphere given on the assumption that no dimples are on the golf ball surface, expressed in percent. With a dimple area coverage of less than 65%, the coverage of dimples over the entire ball surface is too small, failing to take advantage of the function and effect of large deep dimples and thus failing to achieve excellent flight performance.

In one preferred embodiment, the golf ball has a dimple volume occupation of 0.5 to 1.2%. The dimple volume occupation is defined as the sum of volumes of dimple spaces each defined below the plane 9 circumscribed by the dimple edge 8 (see FIG. 2) divided by the entire volume of an imaginary sphere given on the assumption that no dimples are on the golf ball surface, expressed in percent. With a dimple volume occupation of less than 0.5%, the ball would be likely to sky. With a dimple volume occupation of more than 1.2%, the ball would follow a lower trajectory.

In the golf ball of the invention, the arrangement of dimples on the ball surface is not critical and any of well-known arrangements including regular octahedral and icosahedral arrangements may be used. The total number of dimples is usually from 300 to 600.

When the majority of dimples are made as large in diameter and depth as possible and distributed at a high population as described above, the dimple effect is fully exerted and the flight performance is drastically improved.

In the golf ball of the invention wherein the diameter, depth, surface coverage, and volume occupation of dimples are optimized, as described above, for the purpose of improving the flight performance of the ball, the geometrical factors of the dimple edge, especially the edge angle and the radius of curvature at the dimple edge are further optimized so as to eliminate any obstruction against the removal of the ball from a mold.

Specifically, in the golf ball of the invention, the large dimples should have an edge angle θ of up to 30°, preferably 2° to 15°. With an edge angle of more than 30°, the removal of the ball from a mold becomes difficult.

Additionally, the large dimples should have a radius of curvature at the edge of 1 to 50 mm, preferably 1 to 20 mm. With a radius of curvature of less than 1 mm, the ball would follow a lower trajectory. With a radius of curvature of more than 50 mm, the ball would follow a higher trajectory. In either case, the advantages of the invention including smooth removal from the mold and excellent flight performance are not achievable.

Where there are arranged in addition to the large deep dimples, other dimples which are different in diameter and/or depth, it is recommended that the other dimples also have an edge angle and a radius of curvature at the edge in the above-described ranges.

Now that the geometry of the dimple edge is optimized, the golf ball of the invention is readily removed from a mold at the end of molding even though large deep dimples are distributed at a high population even in proximity to the parting line of the mold.

Figure 4:
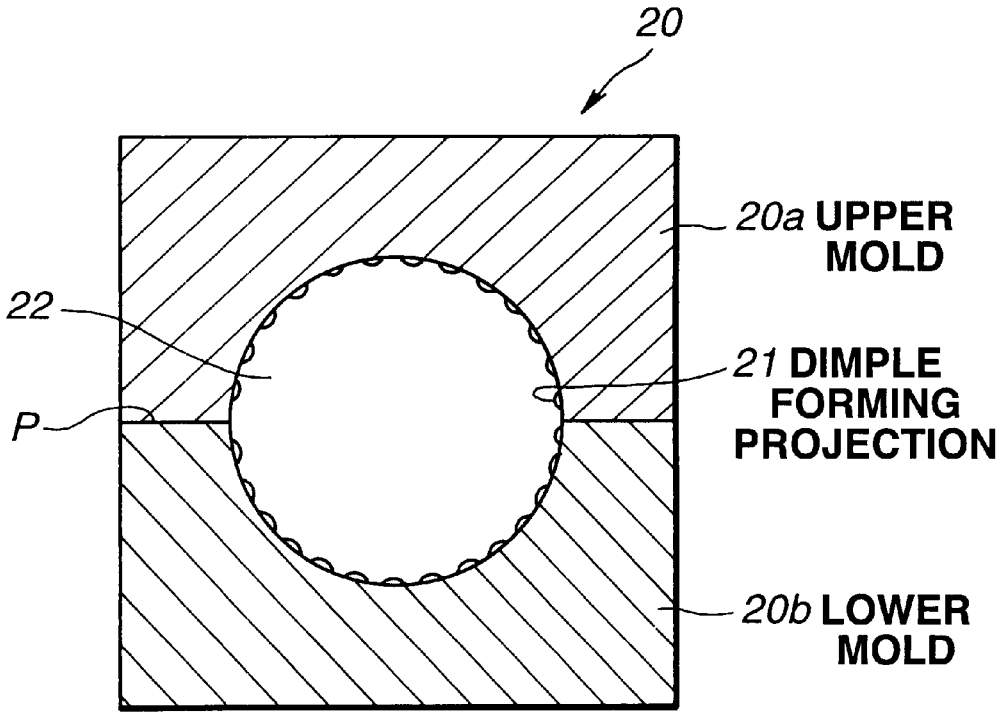
FIG. 4 is a sectional view of a conventional golf ball forming mold.

More specifically, the golf ball of the invention is molded using the mold 20 which is shown in FIG. 4 as comprising the upper and lower mold sections 20*a* and 20*b* which are removably mated along the parting line P (corresponding to the equator of the cavity) to define the spherical cavity 22 having a multiplicity of dimple-forming projections 21 over the entire wall surface. Even when dimples are increased in diameter, depth and population for the purpose of improving flight performance, the further adjustment of the dimples that the edge angle of dimples in cross section is up to 30° and the radius of curvature at the edge is 1 to 50 mm facilitates the removal of the ball from the mold. The reason is that when the molding material is molded in the cavity, the dimple-forming projections are not bit or captured by the dimples in the molded material. This eliminates the inconvenient problems that when the ball is taken out from the mold cavity, some dimples are kept captured with dimple-forming projections disposed near the parting line, disturbing the ball removal from the mold and that if the ball is forcibly taken out of the mold cavity, some dimples can be broken at their edge.

Further, when the mold in which the golf ball of the invention is formed is manufactured, the separation of the mold from the master model in the reversal step is smooth for the same reason, preventing any damage to the master model.

In the golf balls of the invention, no particular limits are imposed on the ball structure other than the above-described dimple structure. The balls may be prepared from well-known materials by conventional techniques to solid golf balls including one-piece golf balls, two-piece golf balls and multi-piece golf balls having a three or more layer structure as well as wound golf balls.

EXAMPLE

Examples of the invention are given below by way of illustration and not by way of limitation.

Example and Comparative Example

Two-piece solid golf balls having a diameter of 42.7 mm and a weight of 45.2 g were prepared in a conventional manner using a mold as shown in FIG. 4. A cured butadiene compound was used as the core stock, and an ionomer resin used as the cover stock.

On the surface of the golf balls, dimples having the parameters shown in Table 1 were distributed in a dimple arrangement as shown in FIG. 1. The total number of dimples was 336.

TABLE 1

| | Diameter (mm) | Depth (mm) | Edge Angle (°) | Radius of curvature at edge (mm) | Surface coverage (%) |
|---|---|---|---|---|---|
| Example | 3.5 | 0.2 | 8 | 10 | 70 |
| Comparison | 3.5 | 0.2 | 60 | 0.2 | 70 |

After the golf balls of Example were molded in the mold, they could be smoothly taken out of the mold without any capture or biting. No flaws were found on the ball surface. The golf balls of Comparative Examples were difficult to take out of the mold. When they were forcibly taken out of the mold, some dimples disposed near the parting line were chipped away and flaws were found around these dimples.

Using a swing robot, the golf balls of the Example and the Comparative Example were hit with a driver at a head speed of 45 m/sec. A total distance was measured and expressed on the basis of a distance of 100 for Comparative Example. The results are shown in Table 2.

TABLE 2

| | |
|---|---|
| Example | 111 |
| Comparative Example | 100 |

There has been described a golf ball having large deep dimples distributed on its surface at a high population, which is readily released from a mold at the end of molding and which exhibits excellent flight performance.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball comprising: a multiplicity of dimples each delimited by an edge, the dimples composed of different types varying in diameter and/or depth and including a majority of large dimples with a diameter of 3.0 to 4.2 mm and a depth of 0.1 to 0.35 mm, said large dimples having an edge angle (θ) of 2° to 15° which is defined as an angle between a tangent line of a dimple edge and a plane circumscribed by dimple edge as a point on an imaginary spherical surface of the golf ball diameter, and a radius of curvature at the edge of 10 to 50 mm which is defined as the radius r of an imaginary circle inscribed to the dimple edge on the boundary between the dimple and the land, and dimples other than said large dimples having said edge angle (θ) of 2° to 15° and said radius of curvature at the edge in the range of 10 to 50 mm, and the dimples whose majority consists of the large dimples accounting for at least 65% of the entire surface area and the large dimples accounting for 50% to 100% of the entire dimples of the ball, and said large dimples being densely distributed in proximity to the equator of the ball corresponding to a mold parting line.

2. The golf ball of claim 1 having a dimple volume occupation of 0.5 to 1.2%, provided that the dimple volume occupation is defined as the sum of volumes of dimple spaces each defined below a plane circumscribed by the dimple edge divided by the entire volume of an imaginary sphere given on the assumption that no dimples are on the golf ball surface.

3. The golf ball of claim 1, wherein the dimples of at most 4 types, which are different in diameter and/or depth are arranged insofar as large circular dimples and are the majority of said dimples.

4. The golf ball of claim 1, wherein said large dimples have a diameter in the range of 3.3 to 4.0 mm.

5. The golf ball of claim 1, wherein said large dimples have a depth in the range of 0.15 to 0.25 mm.

6. The golf ball of claim 1, wherein said large dimples accounting for 65% to 85% of the entire surface area are the majority of the dimples.

* * * * *